United States Patent [19]

Sundermeier et al.

[11] Patent Number: 4,514,021

[45] Date of Patent: Apr. 30, 1985

[54] CABINET WITH DOUBLE DOOR CONSISTING OF AN INNER DOOR AND AN OUTER DOOR

[75] Inventors: Gunter Sundermeier, Bunde; Dieter Waltemate, Hullhorst, both of Fed. Rep. of Germany

[73] Assignee: Paul Hettich & Co., Kirchlengern, Fed. Rep. of Germany

[21] Appl. No.: 486,774

[22] Filed: Apr. 20, 1983

[30] Foreign Application Priority Data

Apr. 27, 1982 [DE] Fed. Rep. of Germany ..... 3215607

[51] Int. Cl.[3] ..... E05F 17/00

[52] U.S. Cl. ..... 312/291; 49/109; 312/292

[58] Field of Search ..... 312/291, 292; 16/365; 49/109

[56] References Cited

U.S. PATENT DOCUMENTS

| | | | |
|---|---|---|---|
| 183,008 | 10/1876 | Jenkins | 16/365 |
| 1,084,480 | 1/1914 | Polverino | 16/365 |
| 1,843,528 | 2/1932 | Warth | 16/365 |
| 1,899,171 | 2/1983 | Warren | 312/291 |
| 2,804,630 | 9/1957 | Gould | 16/365 |

*Primary Examiner*—William E. Lyddane
*Assistant Examiner*—Joseph Falk
*Attorney, Agent, or Firm*—Sprung Horn Kramer & Woods

[57] ABSTRACT

A cabinet with double doors consisting of an inner door and an outer door. The inner door is mounted in such a way as to swing on the hinge axis of the shell of a refrigerator or freezer inside the cabinet and open or close the appliance. A coupling mechanism between the outer and inner doors and the shell of the appliance is associated with the hinges. The coupling mechanism has a drive assembly mounted on the inner door in such a way as to pivot around an axis parallel to that of the hinges. The coupling mechanism is coupled to the shell of the appliance and to the outer door in such a way that the outer door is forced to one side and away from the axis of the hinges when the inner door is opened.

11 Claims, 8 Drawing Figures

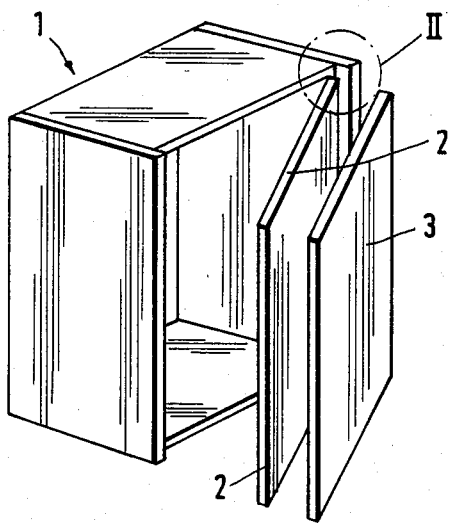
Fig.1
Fig.7
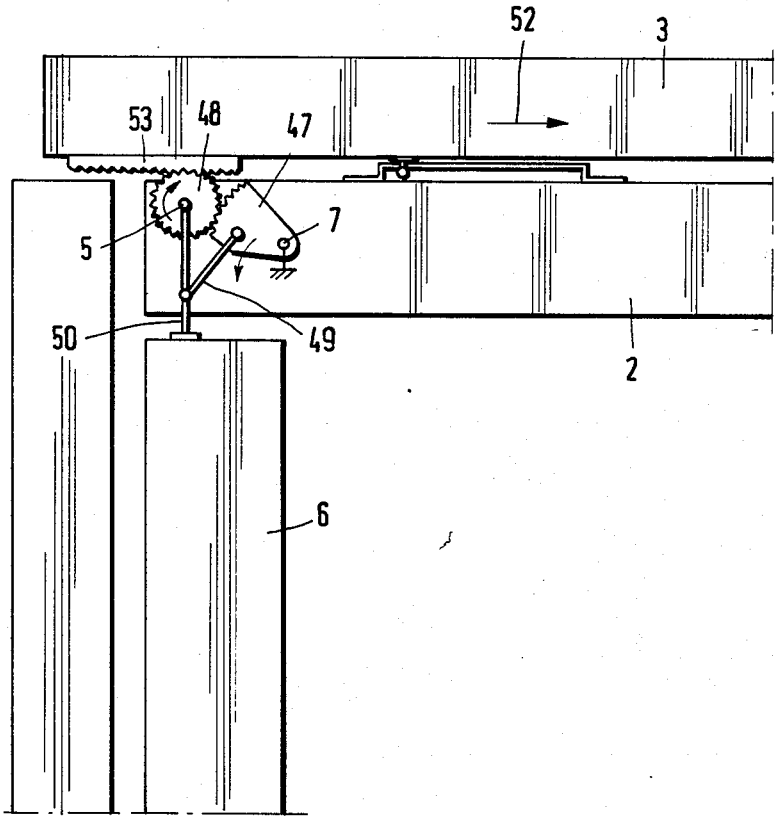

CABINET WITH DOUBLE DOOR CONSISTING OF AN INNER DOOR AND AN OUTER DOOR

BACKGROUND OF THE INVENTION

The present invention relates to a cabinet with a double door consisting of an inner door and an outer door, the inner door mounted in such a way as to swing on an axis determined by hinges attached to the shell of an appliance and the inner and outer doors connected by a slide.

A cabinet of this type in the form of a built-in cabinet containing a refrigerator, freezer, or similar device that can be closed with the inner door is known from German Utility Model 7 339 379. Whereas the inner door can be constructed to satisfy the technical demands of a refrigerator, the outer door can be adapted to match the rest of the kitchen.

As illustrated in FIG. 3 of German Utility Model 7 339 379, the inner door and the outer door are attached to the shell of the appliance with independent hinges. These hinges are relatively expensive to assemble and take up a lot of space. The hinges for the outer door have to be accommodated between the refrigerator and the outer shell of the appliance. The design of the hinges is determined by the range of motion left available to the outer door by adjacent kitchen equipment.

SUMMARY OF THE INVENTION

The invention is intended as a cabinet of the aforesaid type in which the inner and outer door are coupled with a space-saving fitting and linked to the shell, in which the ratio of movement between the outer and the inner door, which make up the double door, as they are opened and closed can be defined over a relatively wide range with means that are simple in design, and which can be adapted to the demands of different cabinet designs.

The invention attains this objective in that at least one coupling mechanism is positioned between the outer door and inner door and the shell of the appliance and that is associated with the hinges, in that the coupling mechanism has a drive assembly that is mounted on the inner door in such a way as to pivot around an axis parallel to that of the hinges and that is coupled to the shell of the appliance and to the outer door in such a way that the outer door is forced to one side and away from the axis of the hinges when the inner door is opened.

The outer door according to the invention has no hinges. The coupling mechanism that is associated with the hinges of the inner door can be designed to save space and either be positioned independent of the hinges of the inner door or extensively integrated into the design of the hinges.

Several different designs that determine the relative motion between the outer door and the inner door within the range of motion available to the outer door as the double door is opened and closed are appropriate for the coupling mechanism.

Some embodiments of the invention will now be specified by way of example with reference to the drawings, in which:

BRIEF DESCRIPTION OF THE DRAWINGS

FIG. 1 is a schematic perspective view of a cabinet with a double door in accordance with the invention and with the double door ajar.

DETAILED DESCRIPTION OF THE PREFERRED EMBODIMENTS

Figure 2:
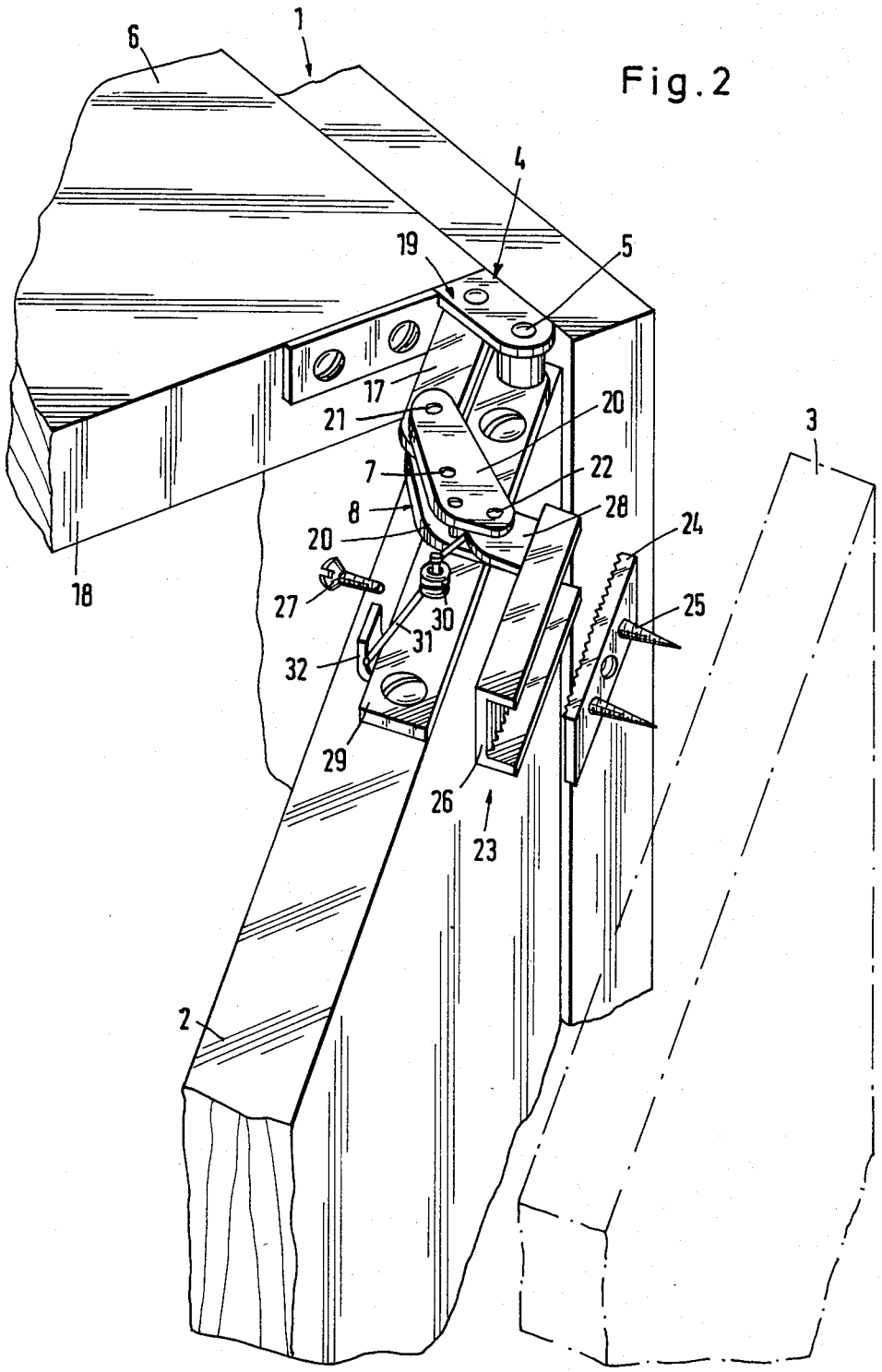
FIG. 2 is an enlarged detail of area II in FIG. 1 with a hinge for the inner door and an associated coupling mechanism.

The cabinet 1 illustrated in FIG. 1 has a double door consisting of an inner door 2 and an outer door 3. The cabinet may be fitted with a refrigerator or freezer with an access for putting objects into or removing them from it that can be closed off by inner door 2. As shown in FIG. 2, inner door 2 is attached to the shell 6 of the appliance by hinges 4 that define an axis 5 around which the inner door 2 is mounted in such a way as to pivot.

Figure 3:
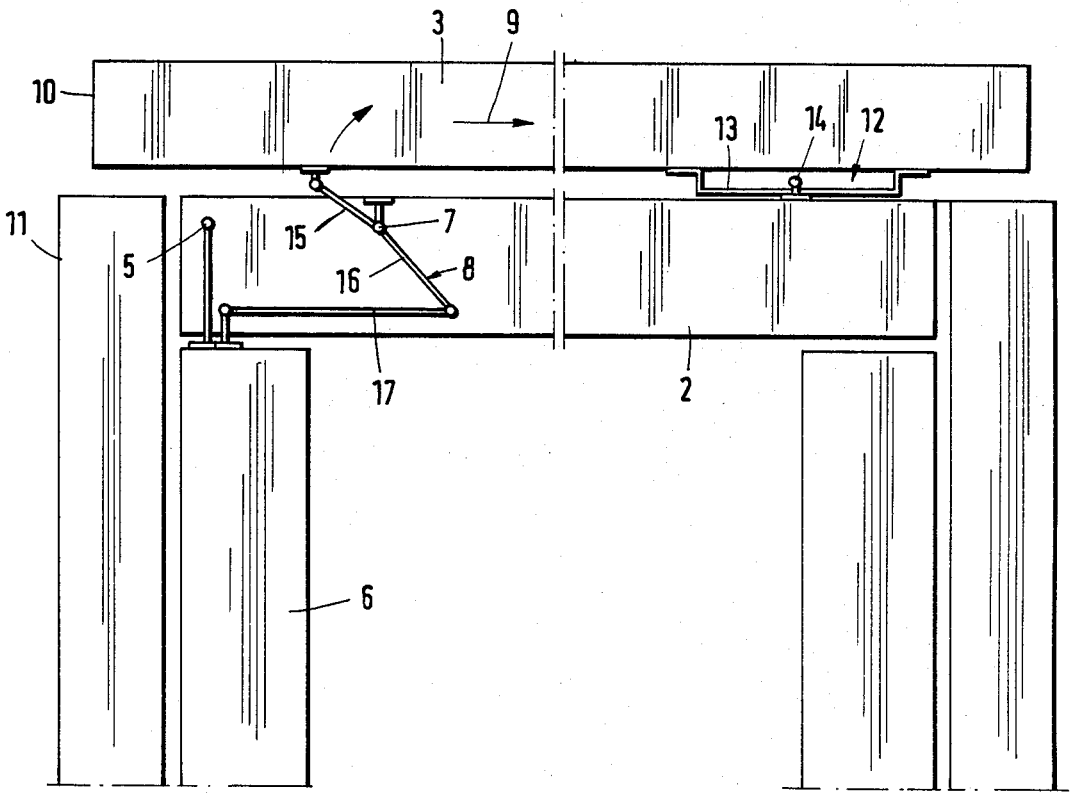
FIG. 3 illustrates the cabinet in FIGS. 1 and 2 with the double door closed and with the coupling mechanism and hinge represented schematically.

A coupling mechanism positioned between outer 3 and inner door 2 and shell 6 is associated with hinge 4. This coupling mechanism has a drive assembly 8 mounted on inner door 2 in such a way as to pivot around an axis 7 that is parallel to the axis 5 of the hinge. As shown in FIG. 3, drive assembly 8 is coupled with the shell 6 of the appliance and with outer door 3 in such a way that the outer door will be forced to one side and away from hinge axis 5 in the direction indicated by arrow 9 when inner door 2 is opened. This prevents the front surface 10 of outer door 3 from entering the plane in which the lateral surface 11 of cabinet 1 lies while inner door 2 is being opened.

A slide 12 consisting of a strap 13 mounted on the inside of outer door 3 and of a traveler 14 mounted on the outside of inner door 2 is positioned between the two doors near the edge where the handle (not shown) is located. Strap 13 has a longitudinal slot in which traveler 14 can slide.

Figure 4:
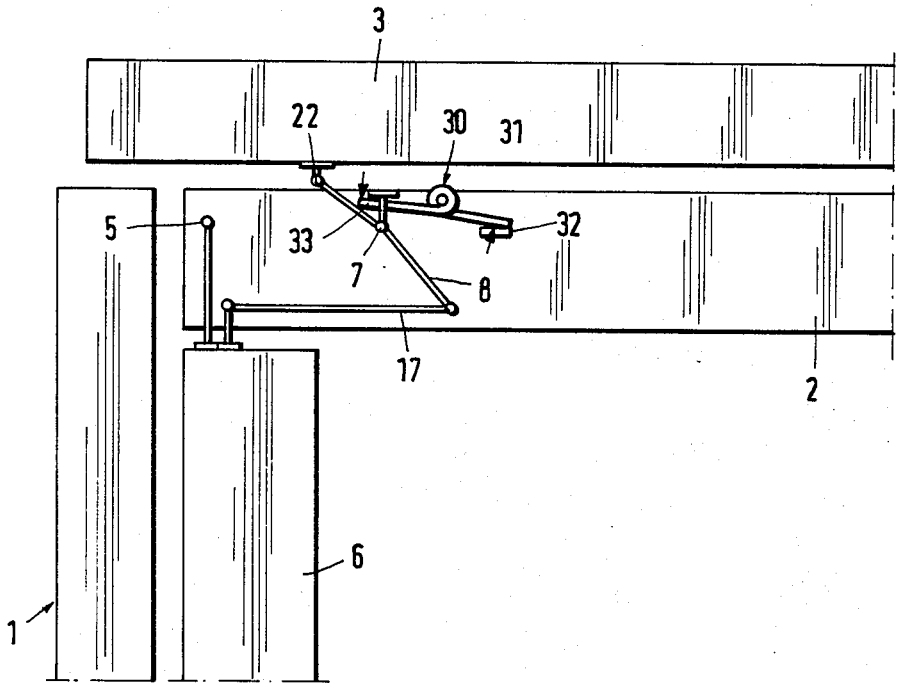
FIG. 4 illustrates the coupling mechanism in FIG. 3 with an associated lever spring, and FIGS. 5–8 schematically illustrate further embodiments of coupling mechanisms positioned between the outer and inner door and the shell of the appliance.

In the coupling mechanism illustrated in FIGS. 2–4, the drive assembly 8 is mounted in such a way as to pivot on inner door 2 and comprises an L-shaped lever with one arm 15 articulating with outer door 3 and its other arm 16 with a link 17 that articulates with the shell 6 of the appliance.

In the embodiment illustrated in FIGS. 2–4, link 17 articulates with a pivot mount 19 attached to the front surface 18 of shell 6.

In the design illustrated in FIG. 2, the drive assembly 8 mounted on inner door 2 in such a way as to pivot and consists of two separate, parallel, and connected brackets 20. Link 17 pivots on a link pin 21 that extends through plates 20. There is another link pin 22 through the end of plates 20 toward outer door 3 on which a fitting 23 attached to outer door 3 pivots. In the embodiment illustrated in FIG. 2, the fitting 23 attached to the inside of the outer door 3 consists of an assembly plate 24 that is attached with screws 25 to outer door 3 and of an arm 26 with a U-shaped cross-section that can be attached with a screw 27 to assembly plate 24. Arm 26 has a plate 28 that pivots on link pin 22.

Drive assembly 8 is mounted in such a way as to pivot on a base plate 29 that is screwed to the bounding surface of inner door 2 that runs at an angle to the axis 5 of the inner-door hinges. A lever spring 30 is also mounted on base plate 29. One leg 31 of lever spring 30 rests against a stop 32 that is rigidly attached to base plate 29 and the other leg 33 against drive assembly 8 between the axis 7 of rotation of assembly 8 and link pin 22.

Lever spring 30 supplies torque to drive assembly 8 around axis 7 during the latter segment of the closure movement of the double door to reinforce the closure of outer door 3. When the double door is opened, this torque must be overcome. No torque is supplied as long as the force exerted by lever spring 30 does not penetrate axis 7. As the double door continues to open, however, lever spring 30 reinforces the motion of outer door 3 in the direction indicated by arrow 9.

Figure 5:
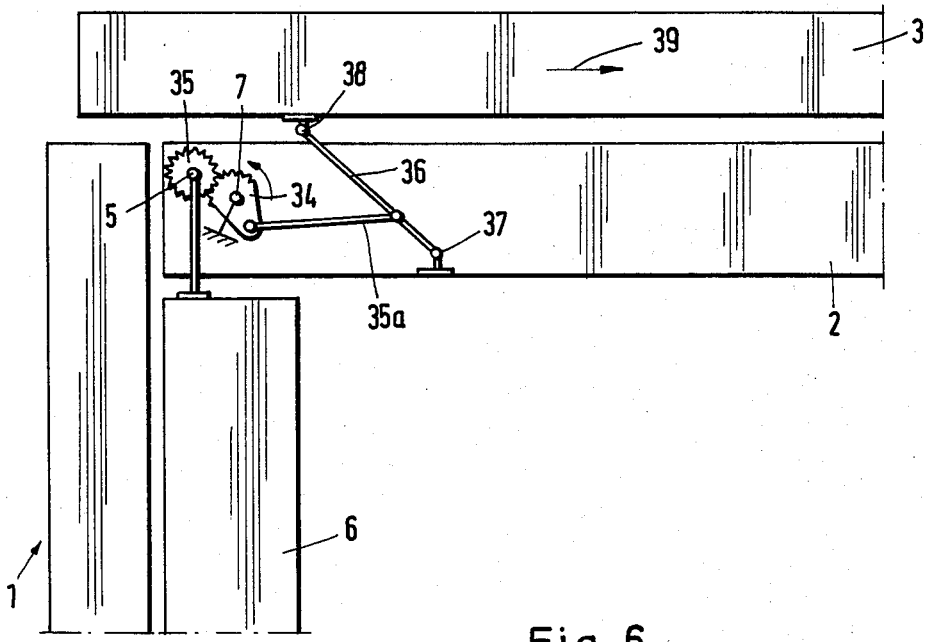

In the embodiment illustrated in FIG. 5, the drive assembly is mounted on inner door 2 in such a way as to pivot around axis 7 and consists of a toothed pinion 35 and toothed quadrant 34. Quadrant 34 meshes with a pinion 35 that is mounted on inner door 2 in such a way as to be unable to pivot around inner-door hinge axis 5. A link 35*a* articulates with toothed quadrant 34 and the other end of link 35*a* with a drive link 36. One end of drive link 36 pivots around an axis 37 on inner door 2 that parallels the axis 5 of the inner-door hinges and the other, free end 38 articulates with outer door 3.

When inner door 2 is opened, toothed quadrant 34 rolls over rigidly mounted pinion 35, rotating drive link 36 clockwise through link 35*a* around axis 37 and forcing outer door 3 in the direction indicated by arrow 39.

Figure 6:
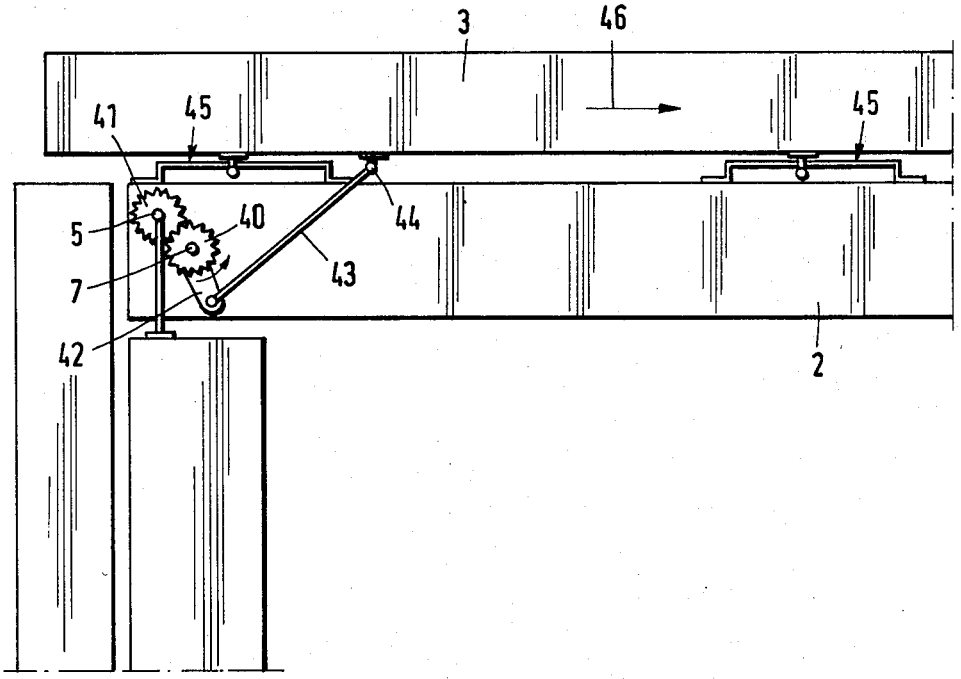

FIG. 6 illustrates a coupling mechanism in which, as in the embodiment illustrated in FIG. 5, a toothed quadrant 40 that is mounted in such a way as to pivot around an axis 7 on inner door 2 meshes with a toothed pinion 41 that is mounted in such a way as to be unable to pivot on hinge axis 5. Toothed quadrant 40 has a rocker 42 that articulates with a drive link 43 that articulates in turn at its lower end 44 with outer door 3. There are slides 45 between inner door 2 and outer door 3 toward the edge of the double door where a handle is located and toward the edge where the hinges are located. When inner door 2 is opened, quadrant 40 rotates counterclockwise around axis 7 and activates drive link 43 through rocker 42, forcing outer door 3 in the direction indicated by arrow 46.

In the embodiment illustrated in FIG. 7, a toothed quadrant 47 is mounted on inner door 2 in such a way as to rotate around an axis 7 that parallels hinge axis 5. A toothed pinion 48 that meshes with quadrant 47 is mounted in such a way as to rotate around axis 5. Toothed quadrant 47 articulates through a connecting rod 49 with a fitting 50 attached to the shell 6 of the appliance. When inner door 2 is opened, pinion 48, which meshes with a toothed rack 53 mounted on the inside of outer door 3, rotates clockwise, forcing the outer door in the direction indicated by arrow 52.

Figure 8:
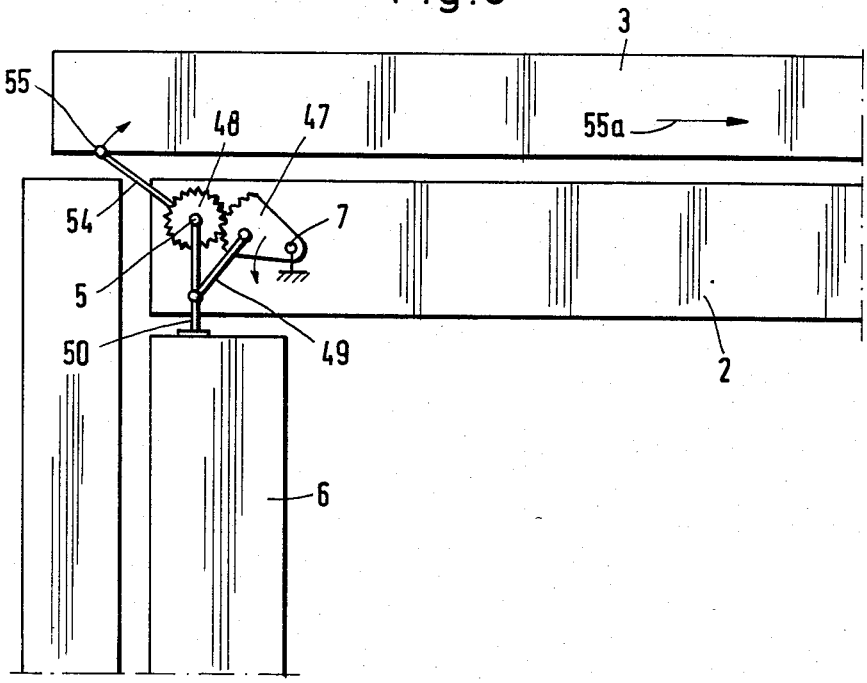

In the variation illustrated in FIG. 8, toothed pinion 48 has a rocker 54 that articulates at its free end 55 with the inside of outer door 3. When inner door 2 is opened, rocker 54 forces outer door 3 in the direction indicated by arrow 55*a*.

It will be appreciated that the instant specification and claims are set forth by way of illustration and not limitation, and that various modifications and changes may be made without departing from the spirit and scope of the present invention.

What is claimed is:

1. In a cabinet receptive of an appliance shell and having a double door including an inner door for the appliance shell and an outer door for the cabinet, hinging means mounted on the inner door and the appliance shell to enable the inner door to pivot on a given axis, the improvement comprising: at least one means coupling the outer door, the inner door and the shell of the appliance to effect the pivotal movement of the inner door about the given axis in response to the opening and closing of the double door and including drive means mounted for pivotal movement on the inner door about an axis parallel to the given axis and is connected to the outer door and the appliance shell for forcing the outer door to one side and away from the given axis when the double door is opening.

2. The cabinet according to claim 1, wherein the drive means comprises a lever mechanism with one arm pivotally connected to the outer door, another arm and a link pivotally connected at one end to the shell of the appliance and at the other end to said another arm.

3. The cabinet according to claim 2, wherein the link is pivotally connected to the shell with a pivot mount attached to the front surface of the shell.

4. The cabinet according to claim 2, wherein the drive means comprises two separate, parallel, and connected brackets having link pins extending therethrough at two ends thereof and pivotally mounted intermediate of the link pins to the inner door, a link pivotally mounted at one end on the link pin and pivotally mounted at the other end on the shell of the appliance and a fitting attached to the outer door and pivotally mounted on the other link pin.

5. The cabinet according to claim 4, wherein the brackets are pivotally mounted on a base plate attached to a bounding surface of the inner door that is not parallel to the axis of the inner-door hinges, and wherein the drive means further comprises a lever spring mounted on the base plate and having one leg resting against a stop rigidly attached to the base plate and another leg acting on the brackets between the pivot axis of of the brackets and said other link pin.

6. The cabinet according to claim 4, wherein the fitting is attached to the inside of the outer door and comprises an assembly plate attached to the outer door, an arm having a U-shaped cross-section that is releasably connected to the assembly plate and a plate extending from the arm which pivots on said other link pin.

7. The cabinet according to claim 1, wherein the drive means comprises a first toothed member mounted on the inner door, a second toothed member meshing with the first toothed member and mounted for pivoting movement about an axis which is unable to be colinear with the inner-door hinge axis and means pivotally connected to the outer door and connected to the first toothed member.

8. The cabinet according to claim 1, wherein the drive means comprises a first toothed member mounted on the inner door for rotation about an axis colinear with the inner door hinge axis, a second toothed member that meshes with the first toothed member and means mounted on the inside of the outer door for rotating the first toothed member upon the movement of the outer door.

9. The cabinet according to claim 8, wherein the second toothed member is mounted on the inner foot for rotation and a connecting rod is pivotally connected at one end to the second toothed member and at the other end to a pivot mount attached to the shell of the appliance.

10. The cabinet according to claim 8, wherein the means for rotating the first toothed member comprises a toothed rack mounted on the inside of the outer door.

11. The cabinet according to claim 8, wherein the means for rotating the first toothed member comprises a rocker pivotally mounted on the inside of the outer door.

* * * * *